US010345751B2

(12) United States Patent
Kawai

(10) Patent No.: US 10,345,751 B2
(45) Date of Patent: Jul. 9, 2019

(54) IMAGE FORMING APPARATUS

(71) Applicant: CANON KABUSHIKI KAISHA, Tokyo (JP)

(72) Inventor: Toshiharu Kawai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/036,674

(22) Filed: Jul. 16, 2018

(65) Prior Publication Data

US 2018/0321624 A1 Nov. 8, 2018

Related U.S. Application Data

(63) Continuation of application No. 14/794,614, filed on Jul. 8, 2015, now Pat. No. 10,054,898.

(30) Foreign Application Priority Data

Jul. 11, 2014 (JP) ..... 2014-143515

(51) Int. Cl.
*G03G 15/00* (2006.01)
*G03G 21/16* (2006.01)

(52) U.S. Cl.
CPC ..... *G03G 15/6529* (2013.01); *G03G 15/80* (2013.01); *G03G 21/1619* (2013.01); *G03G 21/1695* (2013.01); *B65H 2401/115* (2013.01); *B65H 2401/15* (2013.01); *B65H 2402/40* (2013.01); *B65H 2515/702* (2013.01); *G03G 15/6502* (2013.01); *G03G 2215/00978* (2013.01); *G03G 2221/1678* (2013.01)

(58) Field of Classification Search
CPC ..... G03G 21/1619; G03G 2221/1678; G03G 15/80; G03G 2215/00978; B65H 2402/40; B65H 2515/702
See application file for complete search history.

(56) References Cited

U.S. PATENT DOCUMENTS 7,783,226 B2 * 8/2010 Tomatsu ..... G03G 21/1619 399/107
9,304,480 B2 * 4/2016 Nishimura ..... G03G 21/1619
9,785,107 B2 * 10/2017 Nagasaki ..... G03G 21/1619
(Continued)

FOREIGN PATENT DOCUMENTS

JP 2011-112943 A 6/2011
JP 2013-134391 A 7/2013
(Continued)

*Primary Examiner* — Jeremy R Severson
(74) *Attorney, Agent, or Firm* — Canon U.S.A., Inc. IP Division

(57) ABSTRACT

An image forming apparatus includes a first frame member and a second frame member which are aligned in a direction of a rotation axis of an image bearing member and faces each other across an image forming unit and a stacking unit. The first frame member includes a first portion including a first side surface facing the image forming unit and a second portion, which is fixed to the first portion, including a second side surface facing the stacking unit. The second frame member includes a third side surface facing the image forming unit and the stacking unit, and at least a part of the second side surface is provided in a position different from a position of the first side surface in the direction of the rotation axis of the image bearing member.

14 Claims, 11 Drawing Sheets

(56) References Cited

U.S. PATENT DOCUMENTS

| | | | | |
|---|---|---|---|---|
| 9,996,051 | B2 * | 6/2018 | Sato | G03G 15/0216 |
| 10,054,898 | B2 * | 8/2018 | Kawai | G03G 21/1619 |
| 2008/0003015 | A1 * | 1/2008 | Tomatsu | G03G 21/1619<br>399/110 |
| 2010/0014887 | A1 * | 1/2010 | Tomatsu | G03G 21/1853<br>399/107 |
| 2010/0098451 | A1 * | 4/2010 | Tsusaka | G03G 15/80<br>399/90 |
| 2011/0052251 | A1 * | 3/2011 | Kondo | G03G 15/6555<br>399/107 |
| 2011/0129250 | A1 * | 6/2011 | Kondo | G03G 21/1619<br>399/107 |
| 2014/0003837 | A1 * | 1/2014 | Kato | G03G 21/1623<br>399/110 |
| 2014/0079433 | A1 * | 3/2014 | Watanabe | G03G 21/1619<br>399/107 |

FOREIGN PATENT DOCUMENTS

| | | | |
|---|---|---|---|
| JP | 2013-188952 | A | 9/2013 |
| JP | 2014-109633 | A | 6/2014 |

* cited by examiner

IMAGE FORMING APPARATUS

CROSS REFERENCE TO RELATED APPLICATIONS

The present application is a continuation of U.S. patent application Ser. No. 14/794,614, filed on Jul. 8, 2015, which claims priority from Japanese Patent Application No. 2014-143515, filed Jul. 11, 2014, all of which are hereby incorporated by reference herein in their entirety.

BACKGROUND OF THE INVENTION

Field of the Invention

The present invention relates to an image forming apparatus using an electrophotographic method, such as a laser beam printer (LBP), a copying machine, a facsimile machine, and the like.

Description of the Related Art

A frame structure of an image forming apparatus that uses two side plates facing each other across a photosensitive member is known, as discussed in Japanese Patent Application Laid-Open No. 2009-128506. In an image forming apparatus having the frame structure including two side plates, an image forming unit including a photosensitive member and a stacking unit (sheet feeding cassette) that is attachable to and detachable from a main body of the image forming apparatus and on which sheets to be conveyed to the image forming unit are stacked are provided between the two side plates.

Meanwhile, the distance between the two side plates is generally determined by a length of the widest object among members provided between the two side plates. For example, in a case of a configuration in which a tray supporting a cartridge is provided and the tray can be inserted and removed as discussed in Japanese Patent Application Laid-Open No. 2009-128506, the tray and a tray insertion/removal mechanism need to be provided between the two side plates. However, the smallest width of the sheet feeding cassette is not always the same as the smallest width of the tray and the tray insertion/removal mechanism. Thus, if the distance between the two side plates is set to allow the tray, the tray insertion/removal mechanism, and the sheet feeding cassette to fit in the space between the two side plates, an empty space is formed in a portion between the two side plates and the tray and the tray insertion/removal mechanism or in a portion between the two side plates and the sheet feeding cassette. The empty space causes an excessive increase in the volume of the image forming apparatus, whereby it becomes difficult to reduce the size of the image forming apparatus.

SUMMARY OF THE INVENTION

The present invention is directed to providing an image forming apparatus that enables effective use of a space within the image forming apparatus in response to the above issue.

According to an aspect of the present invention, an image forming apparatus includes an image forming unit configured to transfer a toner image formed on an image bearing member onto a recording medium, a stacking unit on which a recording medium to be conveyed to the image forming unit is stacked, and, a first frame member and a second frame member which are aligned in a direction of a rotation axis of the image bearing member and face each other across the image forming unit and the stacking unit, wherein the first frame member includes a first portion and a second portion, the first portion including a first side surface facing the image forming unit, the second portion being provided separately from the first portion and including a second side surface facing the stacking unit, and the second portion is fixed to the first portion, wherein the second frame member includes a third side surface facing the image forming unit and the stacking unit, and the second frame member is an integrally-formed frame member, and wherein at least a part of the second side surface is provided in a position different from a position of the first side surface, in the direction of the rotation axis of the image bearing member.

According to another aspect of the present invention, an image forming apparatus includes an image forming unit configured to transfer a toner image formed on an image bearing member onto a recording medium, a stacking unit on which a recording medium to be conveyed to the image forming unit is stacked, and a first frame member and a second frame member which are aligned in a direction of a rotation axis of the image bearing member and face each other across the image forming unit and the stacking unit, wherein the first frame member includes a first portion and a second portion, the first portion including a first side surface facing the image forming unit, the second portion being provided separately from the first portion and including a second side surface facing the stacking unit, and the second portion is fixed to the first portion, wherein the second frame member includes a third side surface facing the image forming unit and the stacking unit, the first portion is formed of a metal, and the second portion is formed of a resin, and wherein at least a part of the second side surface is provided in a position different from a position of the first side surface in the direction of the rotation axis of the image bearing member.

Further features of the present invention will become apparent from the following description of exemplary embodiments with reference to the attached drawings.

DESCRIPTION OF THE EMBODIMENTS (Entire Schematic Structure of Image Forming Apparatus)

Figure 1:
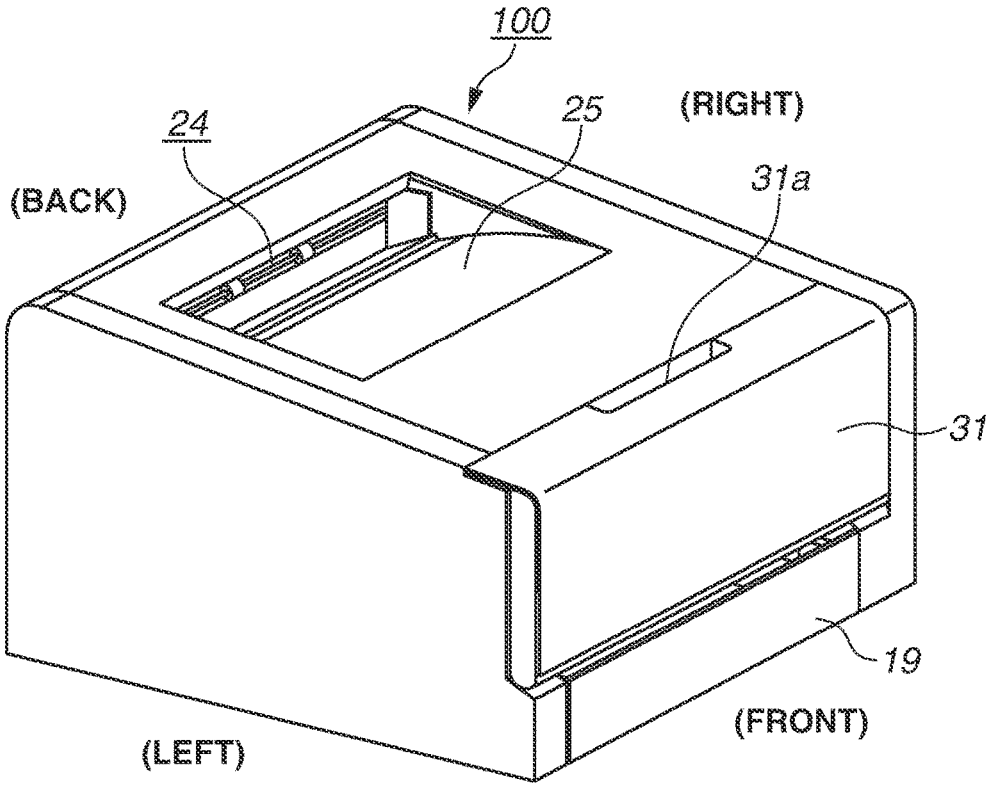
FIG. 1 is a perspective view illustrating an image forming apparatus.
Figure 2:
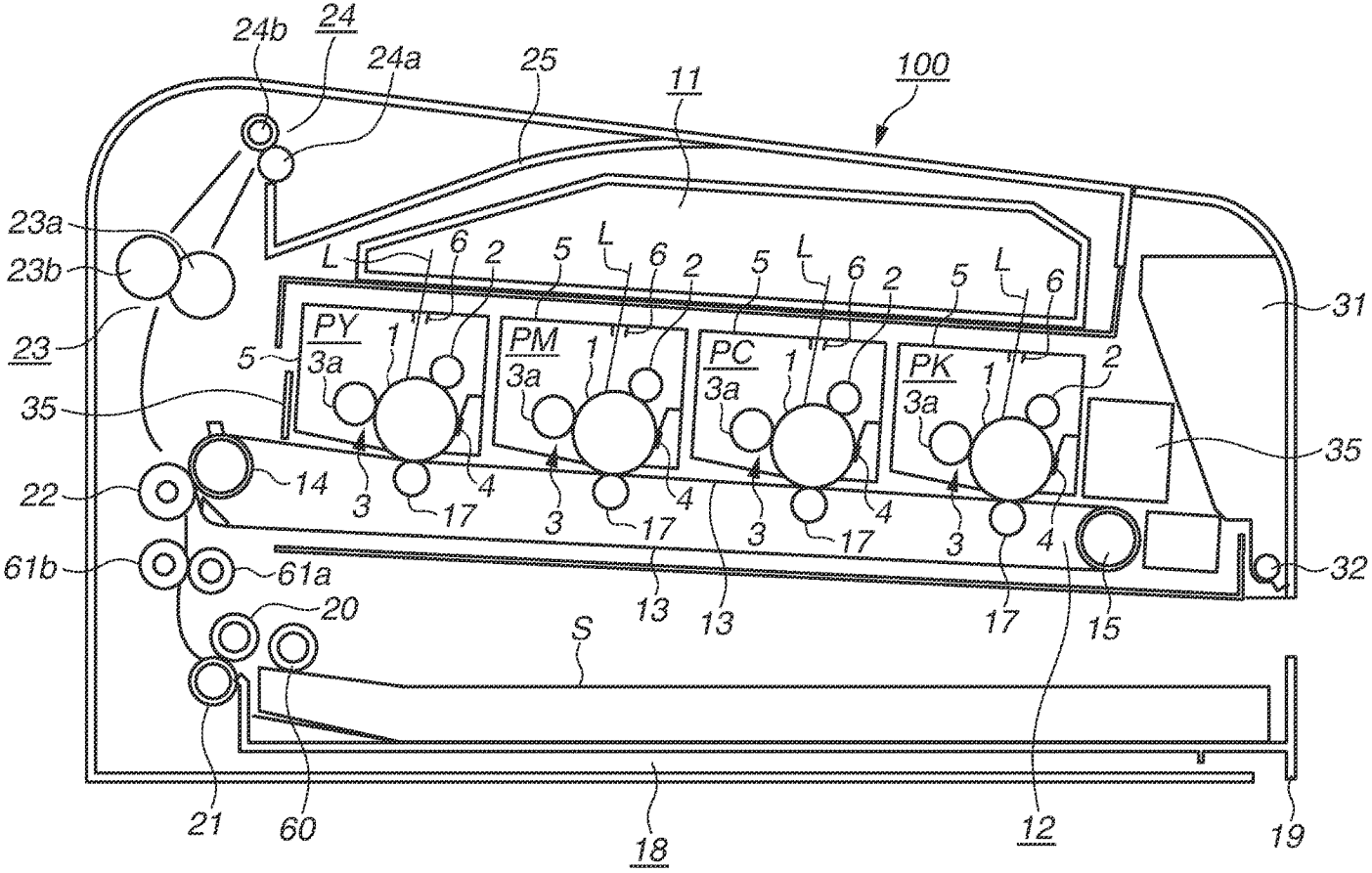
FIG. 2 is a schematic cross sectional view illustrating the image forming apparatus.

An entire schematic structure of an image forming apparatus will be described. FIG. 1 is an external perspective view illustrating an image forming apparatus 100, and FIG. 2 is a schematic cross sectional view illustrating the image forming apparatus 100, viewed along a direction of a rotation axis of photosensitive drums 1.

The image forming apparatus 100 is a full-color electrophotographic laser printer using four colors. The image forming apparatus 100 forms a toner image on a recording medium having a sheet shape (sheet) based on image signals input from an external host device (not illustrated), such as a personal computer, an image reader, a sender facsimile machine, and the like.

As used herein, the "front" of the image forming apparatus (also referred to as "main body") 100 is a side on which a door 31 of the main body 100 is provided. The "back" is a side that is opposite to the "front." The "left" is a left hand side of the main body 100, viewed from the "front" side of the main body 100, and the "right" is a right hand side of the main body 100, viewed from the "front" side of the main body 100.

In the main body 100, four cartridges P (PY, PM, PC, PK) are aligned and attached in a substantially horizontal direction from the back to the front. The cartridges P have a similar structure each other, except that colors of contained toner are different from each other, and operate similarly. Each of the cartridges P includes a photosensitive drum (photosensitive member) 1 as a first image bearing member, a charging unit 2, a development unit 3, a cleaning unit 4, and a frame 5. The charging unit 2, the development unit 3, and the cleaning unit 4 are processing units that perform operations on the photosensitive drum 1, and the frame 5 supports the photosensitive drum 1 and the processing units. When the cartridge P is attached to the main body 100, the photosensitive drum 1 in the cartridge P is rotatably supported. The charging unit 2 includes a charging roller. The development unit 3 includes a development roller 3*a*, and a developer agent (toner) is contained in the development unit 3. The cleaning unit 4 includes a cleaning blade that is in contact with the photosensitive drum 1.

The first cartridge PY contains yellow (Y) toner in the development unit 3 and forms a yellow toner image on a surface of the photosensitive drum 1. The second cartridge PM contains magenta (M) toner in the development unit 3 and forms a magenta toner image on a surface of the photosensitive drum 1. The third cartridge PC contains cyan (C) toner in the development unit 3 and forms a cyan toner image on a surface of the photosensitive drum 1. The fourth cartridge PK contains black (K) toner in the development unit 3 and forms a black toner image on a surface of the photosensitive drum 1.

Above the four cartridges P (PY, PM, PC, PK), there is provided a laser scanner unit 11. The laser scanner unit 11 emits to each photosensitive drum 1 a laser light beam L modulated based on image information about each color that is input from an external host device. Each laser light beam L passes through an opening 6 formed in an upper surface of the frame 5 of each of the cartridges P and reaches the surface of the photosensitive drum 1, and the surface of the photosensitive drum 1 is scanned and exposed with the laser light beams L.

Below the four cartridges P (PY, PM, PC, PK), there is provided a belt unit 12. The belt unit 12 includes a belt 13, which has flexibility and an endless shape as an intermediate transfer member (second image bearing member), a driving roller 14, and a tension roller 15. The belt 13 is wound and stretched tightly around the driving roller 14 and the tension roller 15, and the driving roller 14 and the tension roller 15 circulate (rotate) the belt 13. The driving roller 14 is provided in the back side of the main body 100. The tension roller 15 is provided in the front side of the main body 100. A rotation axis of the belt 13, which is circulated (rotated), is a rotation axis of the driving roller 14 or the tension roller 15. The rotation axes of the driving roller 14 and the tension roller 15 are parallel to a rotation axis of the photosensitive drum 1.

A lower surface of the photosensitive drum 1 of each of the cartridges P is in contact with an upper surface of an upper path side of the belt 13. On the inner side of the belt 13, there are provided four primary transfer rollers 17 each facing the photosensitive drum 1 of corresponding cartridge P via the upper path side belt portion. The driving roller 14 is in contact with a secondary transfer roller 22 via the belt 13.

Below the belt unit 12, a sheet feeding unit 18 is provided. The sheet feeding unit 18 includes a sheet feeding cassette 19, a sheet feeding roller 60, a conveyor roller 20, and a separation roller 21. The sheet feeding cassette 19 is a stacking unit for storing and stacking recording mediums (sheets) S. The sheet feeding cassette 19 can be attached to or removed from the main body 100 by inserting or removing the sheet feeding cassette 19 into or from the front side of the main body 100. The sheet feeding roller 60 and the conveyor roller 20 are conveying members for conveying a recording medium from the sheet feeding cassette 19.

A fixing device 23 and a sheet discharge roller pair 24 are provided in an upper portion of the back side of the main body 100. An upper surface of the main body 100 is a sheet discharge unit 25. A fixing device 23 includes a fixing film assembly 23*a* and a pressing roller 23*b*. The sheet discharge roller pair 24 includes sheet discharge rollers 24*a* and 24*b*.

When the cartridges P are attached to the main body 100, the frame 5 and the photosensitive drum 1 of each of the cartridges P are positioned in predetermined positions by a positioning unit (not illustrated) included in the main body 100. In this state, a driving input unit of each of the cartridges P is joined to a driving mechanism 52 (refer to FIGS. 6A and 6B) included in the main body 100, and an electrical contact of each of the cartridges P is electrically connected to a high-voltage power supply unit 53 (refer to FIGS. 6A and 6B). Thus, the photosensitive drum 1 and the processing units are ready to operate.

The cartridges P and the belt unit 12 correspond to the image forming unit for transferring toner images held on the photosensitive drums 1 and the belt 13 onto a recording medium. A recording medium stacked in the sheet feeding cassette 19 is conveyed to a secondary transfer unit (secondary transfer nip portion) between the secondary transfer roller 22 and the belt 13 in the image forming unit.

(Image Forming Operation)

An image forming operation for forming a full-color image will be described. The photosensitive drums 1 of the first to fourth cartridges PY, PM, PC, and PK are rotated and driven at a predetermined control speed. The belt 13 is also rotated and driven at a speed corresponding to the speed of the photosensitive drums 1. The laser scanner unit 11 is also driven. In synchronization with the driving, the charging roller 2 uniformly charges the surface of the photosensitive drum 1 in each of the cartridges P to a predetermined polarity/potential at predetermined control timing. The laser scanner unit 11 scans and exposes the surface of each photosensitive drum 1 with a laser light beam L modulated according to an image signal of each color. Consequently, an electrostatic latent image corresponding to the image signal of the corresponding color is formed on the surface of each photosensitive drum 1. Then, the development roller 3*a* attaches toner to the electrostatic latent image to form a toner image on the photosensitive drum 1.

As a result of the foregoing electrophotographic image formation process operations, a toner image corresponding to a yellow component of a full-color image is formed on the photosensitive drum 1 of the cartridge PY, and the toner image is primary-transferred onto the belt 13. Similarly, a magenta toner image corresponding to a magenta component of the full-color image is formed on the photosensitive drum 1 of the cartridge PM, and the magenta toner image is primary-transferred onto the belt 13 in such a manner that the magenta toner image is superimposed on the already-transferred yellow toner image. Similarly, a cyan toner image corresponding to a cyan component of the full-color image is formed on the photosensitive drum 1 of the cartridge PC, and the cyan toner image is primary-transferred onto the belt 13 in such a manner that the cyan toner image is superimposed on the already-transferred yellow and magenta toner images. Similarly, a black toner image corresponding to a black component of the full-color image is formed on the photosensitive drum 1 of the cartridge PC, and the black toner image is primary-transferred onto the belt 13 in such a manner that the black toner image is superimposed on the already-transferred yellow, magenta, and cyan toner images. Consequently, a full-color toner image of yellow, magenta, cyan, and black is formed on the belt 13. The primary transfer of each toner image is caused by a primary transfer bias voltage applied to the corresponding primary transfer rollers 17.

The toner remaining on the surface of the photosensitive drum 1 of each of the cartridges P after the primary transfer is removed from the surface of the photosensitive drum 1 by the cleaning unit 4.

Meanwhile, the sheet feeding roller 60 is driven at predetermined control timing. This causes a sheet S, which is a recording medium, stacked on the sheet feeding cassette 19 to be separated from other sheets S, conveyed through the conveyor roller 20, the separation roller 21, and the pair of conveyor rollers 61*a* and 61*b*, and then introduced to a nip portion (secondary transfer nip portion) of the secondary transfer roller 22 and the belt 13. Since a secondary transfer bias voltage is applied to the secondary transfer roller 22, the four-color superimposed toner images on the belt 13 are collectively transferred onto a surface of the sheet S while the sheet S is nipped and conveyed through the nip portion.

The sheet S is separated from the surface of the belt 13, introduced to the fixing device 23, and heated and pressed by a fixing nip portion, whereby the toner image is fixed to the sheet S. Then, the sheet S exits the fixing device 23 and is discharged onto the sheet discharge unit 25 by the sheet discharge roller pair 24.

The toner remaining on the surface of the belt 13 after the secondary transfer electrostatically adheres to the surface of the photosensitive drum 1 in a primary transfer portion of the cartridge PY and is removed by the cleaning unit 4.

(Replacement of Cartridges)

Figure 3:
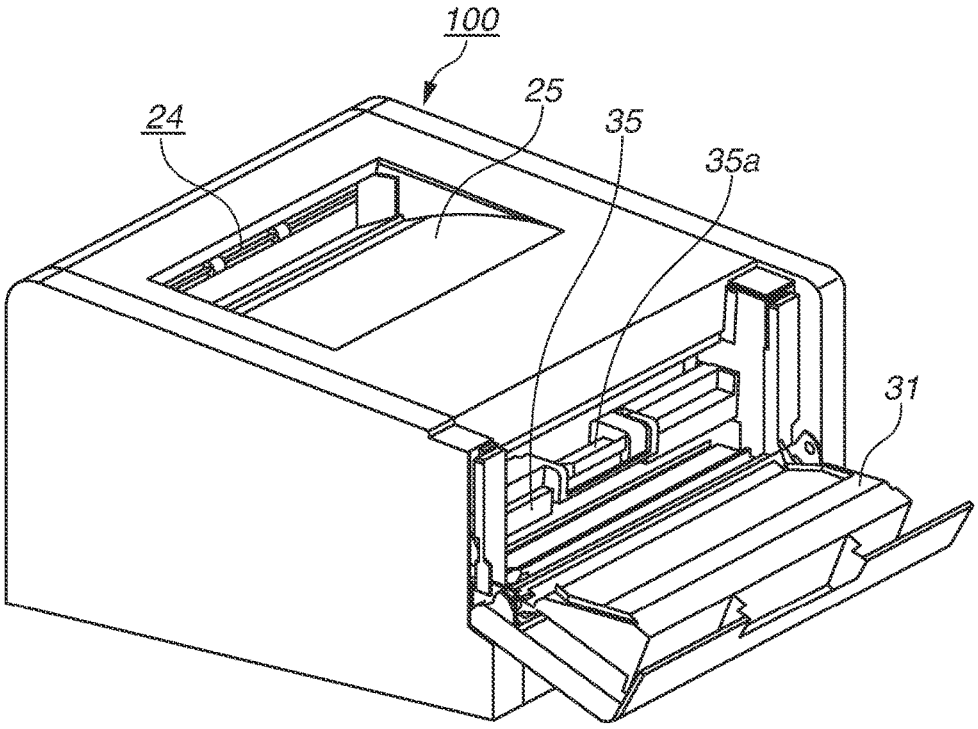
FIG. 3 is a perspective view illustrating the image forming apparatus.
Figure 4:
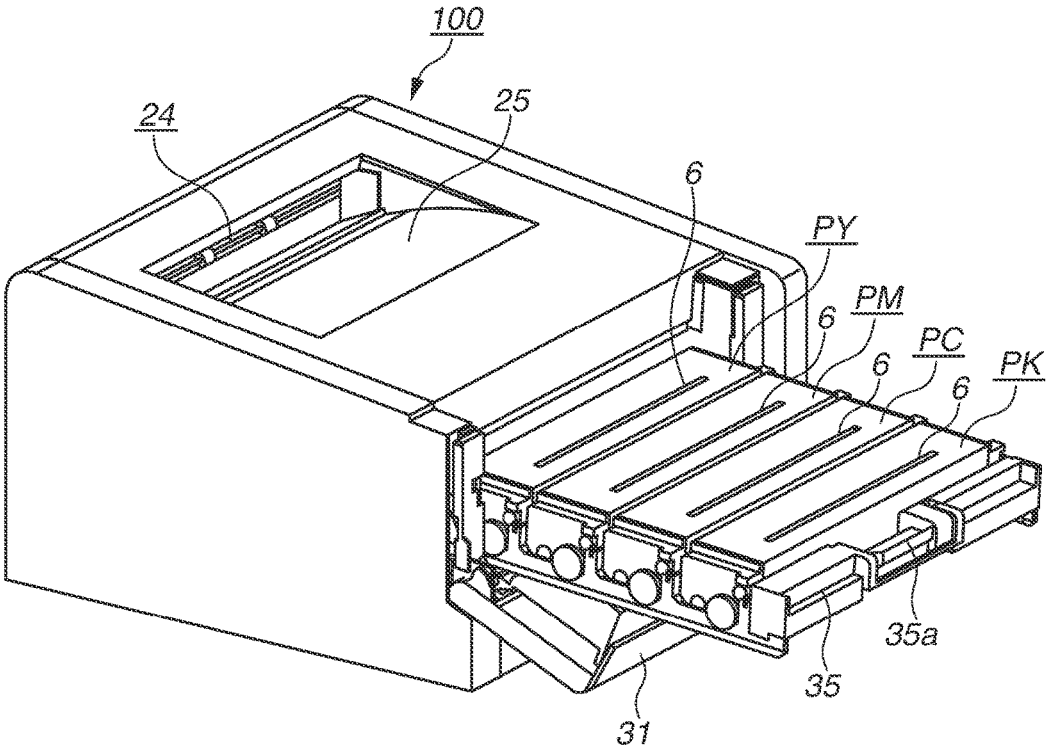
FIG. 4 is a perspective view illustrating the image forming apparatus.

Replacement of each of the cartridges P will be described. FIGS. 3 and 4 are perspective views each illustrating the image forming apparatus 100. When each of the cartridges P is removed from the main body 100, a door is opened first, and a handle 35*a* of a tray 35 is exposed, as illustrated in FIG. 3. The tray 35 is a moving member movable while supporting each of the cartridges P. In the state illustrated in FIG. 3, the tray 35 is positioned inside the main body 100, and then a user grips the handle 35*a* to pull out the tray 35 so that the tray 35 is moved to a position outside the main body 100, as illustrated in FIG. 4. When the tray 35 is positioned outside the main body 100, each of the cartridges P can be removed from the tray 35 and replaced. When each of the cartridges P is attached to the main body 100, the reverse operations of the foregoing operations may be performed.

The direction in which the tray 35 is moved is a direction that is orthogonal to the rotation axis direction (longitudinal direction of cartridge P) of the photosensitive drum 1. Further, the tray 35 is only required to directly or indirectly support the photosensitive drums 1. Specifically, the tray 35 may be configured to indirectly support the photosensitive drums 1 via the frames 5 of the cartridges P, or the tray 35 may be configured to directly support the photosensitive drums 1.

(Frame Structure)

Figure 5:
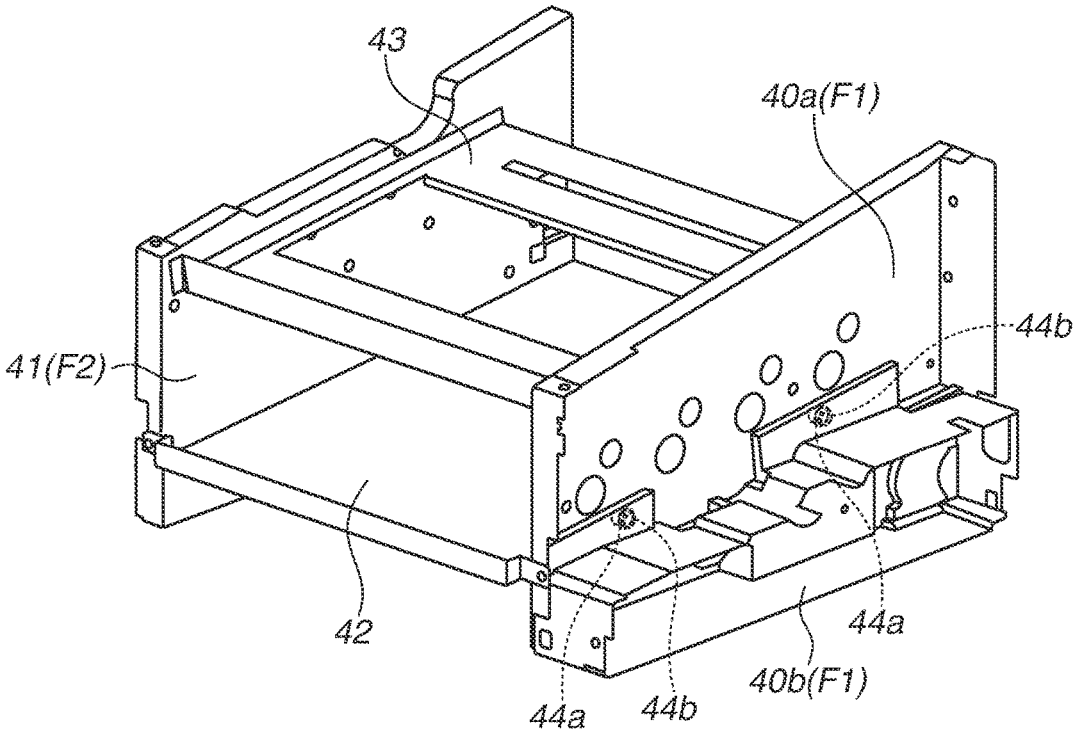
FIG. 5 is a perspective view illustrating a frame structure of the image forming apparatus.

FIG. 5 is a perspective view illustrating a frame structure of the image forming apparatus 100. Hereinafter, the axial direction (longitudinal direction of cartridge P) of the photosensitive drum 1 will be referred to as an X direction, and the vertical direction as a Z direction. The image forming apparatus 100 includes a first frame F1 and a second frame F2 as members included in a frame structure. The first frame F1 is a first frame member on the right side of the main body 100, and the second frame F2 is a second frame member on the left side of the main body 100. The image forming apparatus 100 further includes two stay members connecting the first and second frames F1 and F2 together. The first frame F1 includes a right side plate (first portion) 40*a* and a sheet feeding unit frame (second portion) 40*b*, and the second frame F2 includes a left side plate 41. The two stay members are a basal plate 42 and a scanner stay 43. Each of the right side plate 40*a*, the sheet feeding unit frame 40*b*, the left side plate 41, the basal plate 42, and the scanner stay 43 is a plate-shaped metallic member. The sheet feeding unit frame 40*b* is a resin member. The right side plate 40*a* is provided in a portion of the first frame F1 facing the image forming unit (each of the cartridges P, belt unit 12) in the X direction. The sheet feeding unit frame 40*b* is provided in a portion of the first frame F1 facing the sheet feeding cassette 19 in the X direction below the image forming unit.

In a state where the right side plate 40*a* and the left side plate 41 are butted to the basal plate 42 and the scanner stay 43 in the X direction, the right side plate 40*a* and the left side plate 41 are fixed to the basal plate 42 and the scanner stay 43. The right side plate 40*a* and the left side plate 41 are butted to the basal plate 42 and the scanner stay 43 in this way to determine the distance between the right side plate 40*a* and the left side plate 41 in the X direction.

Positioning of the right side plate 40*a* and the sheet feeding unit frame 40*b* will be described. The right side plate 40*a* includes two through holes 44*a* in the X direction. The two holes 44*a* are formed on the right side plate 40*a* by stamping in the X direction. Further, the sheet feeding unit frame 40*b* includes two protruded portions (bosses) 44*b* protruding in the X direction toward the right side plate 40*a*.

The two protruded portions 44*b* are respectively inserted in the two holes 44*a* to determine the position of the sheet feeding unit frame 40*b*, and the sheet feeding unit frame 40*b* is fixed to the right side plate 40*a*. The two protruded portions 44*b* are respectively butted to inner surfaces of the two holes 44*a* to determine the position of the sheet feeding unit frame 40*b* with respect to the right side plate 40*a* in the Z direction and a direction orthogonal to the Z and X directions. As to the X direction, a butting portion (not illustrated) provided to the sheet feeding unit frame 40*b* is butted to the right side plate 40*a* to determine the position.

Figure 6A:
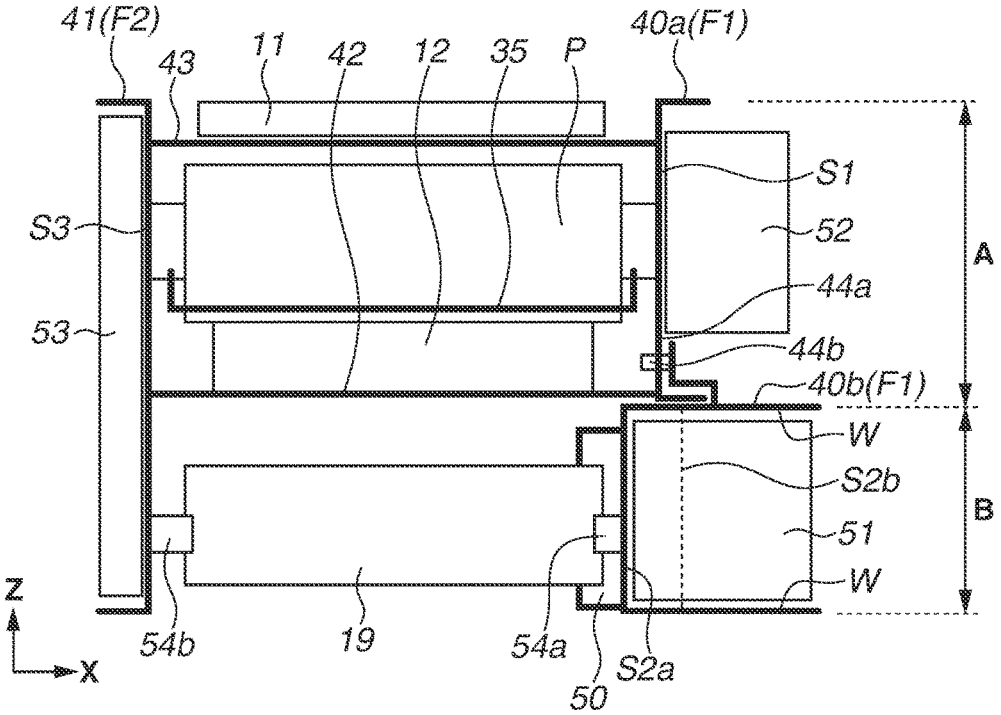
FIG. 6A is a front view illustrating the frame structure of the image forming apparatus and members supported by the frame structure.
Figure 6B:
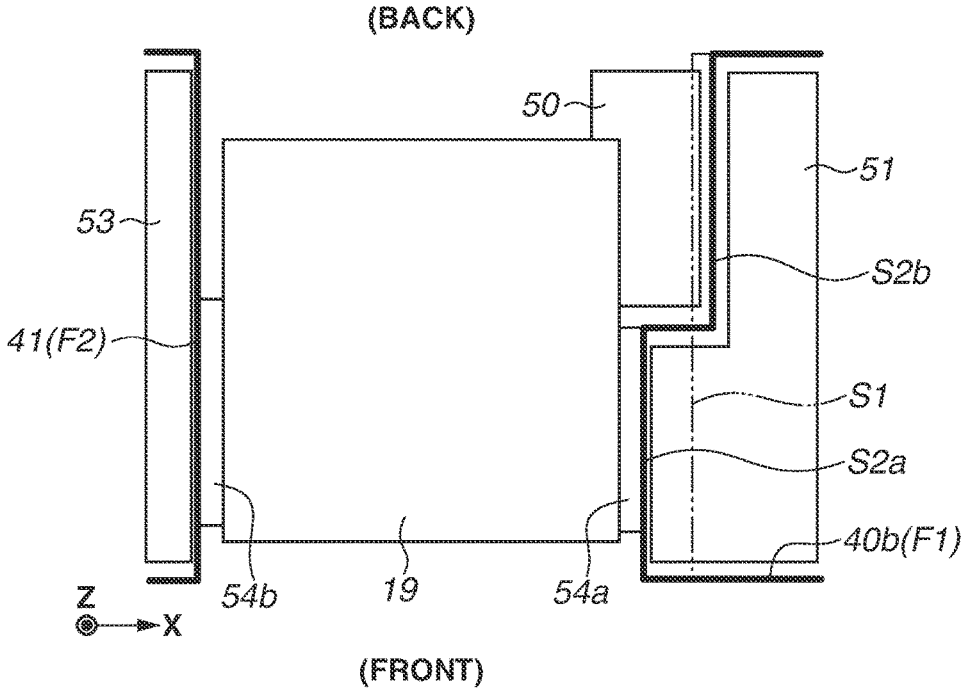
FIG. 6B is a top view illustrating the frame structure of the image forming apparatus and the members supported by the frame structure.

FIGS. 6A and 6B are diagrams each illustrating the frame structure of the image forming apparatus 100 and members supported by the frame structure. FIG. 6A is a front view, and FIG. 6B is a top view. The cartridge P, the belt unit 12, and the tray 35 are provided between the right side plate 40*a* and the left side plate 41. Further, the sheet feeding cassette 19 is provided between the sheet feeding unit frame 40*b* and the left side plate 41.

The right side plate 40*a* includes a first side surface S1 orthogonal to the X direction, and the driving mechanism 52 of the cartridge P is supported on a side (outer side) of the first side surface S1 that is opposite to the cartridge P. The driving mechanism 52 is an image bearing member driving unit including a motor, a gear train, and the like, for rotating and driving the photosensitive drum 1 and the belt 13.

The sheet feeding unit frame 40*b* includes two second side surfaces S2*a* and S2*b*, which are orthogonal to the X direction. The two second side surfaces S2*a* and S2*b* are provided in different positions in the X direction. The second side surface S2*a* is provided closer to the sheet feeding cassette 19 than the first side surface S1, and the second side surface S2*b* is provided on a side opposite to the sheet feeding cassette 19, in the X-direction.

The sheet feeding unit frame 40*b* supports the sheet feeding cassette 19 in such a manner that the sheet feeding cassette 19 is movable to the side (inner side) of the second side surface S2*a* that faces the sheet feeding cassette 19, and the sheet feeding unit frame 40*b* supports a guide unit (support unit) 54*a* configured to guide the movement of the sheet feeding cassette 19. A sheet feeding driving unit (conveying member driving unit) 50 is supported on the side (inner side) of the second side surface S2*b* that faces the sheet feeding cassette 19. The sheet feeding driving unit 50 includes a motor, a gear train, and the like, for driving conveying members (sheet feeding roller 60 and conveyor roller 20), and the like, to cause the sheet feeding unit 18 to operate. Further, a power supply unit 51 is supported on the side (outer sides) of the second side surfaces S2*a* and S2*b* that is opposite to the sheet feeding cassette 19. The power supply unit 51 functions as a low-voltage power supply unit (primary power supply unit) configured to supply power to the image forming apparatus 100.

A wall surface portion W is formed on the side of the second side surfaces S2*a* and S2*b* that is opposite to the sheet feeding cassette 19. The wall surface portion W protrudes in the X direction from the second side surfaces S2*a* and S2*b* to the side (outer side) that is opposite to the sheet feeding cassette 19. The wall surface portion W is provided to surround the power supply unit 51 as viewed in the X direction, and the sheet feeding unit frame 40*b* is a non-flammable resin member, whereby the wall surface portion W and the second side surfaces S2*a* and S2*b* function as a fireproof enclosure.

The left side plate 41 includes a third side surface S3 orthogonal to the X direction and supports a high-voltage power supply unit (secondary power supply) 53 on the side (outer side) of the third side surface S3 that is opposite to the cartridge P. The high-voltage power supply unit 53 converts low-voltage power supplied from the power supply unit 51 to high-voltage power by boosting a voltage and supplies a bias voltage to the cartridge P, the belt unit 12, and the like. The left side plate 41 supports a rail (support unit) 54*b* on the side (inner side) of the third side surface S3 that faces the sheet feeding cassette 19. The rail 54*b* movably supports the sheet feeding cassette 19.

The basal plate 42 supports the belt unit 12, and the scanner stay 43 supports the laser scanner unit 11.

In the frame structure according to the present exemplary embodiment, the right side plate 40*a* is provided in a portion A, which is a portion overlapping the image forming unit in the Z direction, and the sheet feeding unit frame 40*b* is provided in a portion B, which is a portion overlapping the sheet feeding cassette 19 in the Z direction. Further, the positions of the second side surfaces S2*a* and S2*b* of the sheet feeding unit frame 40*b* in the X direction are different from the position of the first side surface S1 of the right side plate 40*a*. In this structure, the width of a space between the first frame F1 (right side plate 40*a* and sheet feeding unit frame 40*b*) and the second frame F2 (left side plate 41) in the X direction in the portion A can be set differently from the width in the portion B. Further, the second side surfaces S2*a* and S2*b* are provided in different positions in the X direction. In this structure, the width of the space between the first frame F1 (right side plate 40*a* and sheet feeding unit frame 40*b*) and the second frame F2 (left side plate 41) in the X direction can be set differently also in the portion B.

As described above, the first frame F1 includes a plurality of members (right side plate 40*a* and sheet feeding unit frame 40*b*) so that the first side surface S1 and the second side surfaces S2*a* and S2*b* can be provided in appropriate positions according to the widths of the members provided between the first frame F1 and the second frame F2 and the widths of the members supported by the first frame F1. Thus, each member can be provided in such a manner that a wasted space is less likely to be formed. Therefore, an excessive increase in the entire volume of the image forming apparatus 100 can be prevented.

Figure 7A:
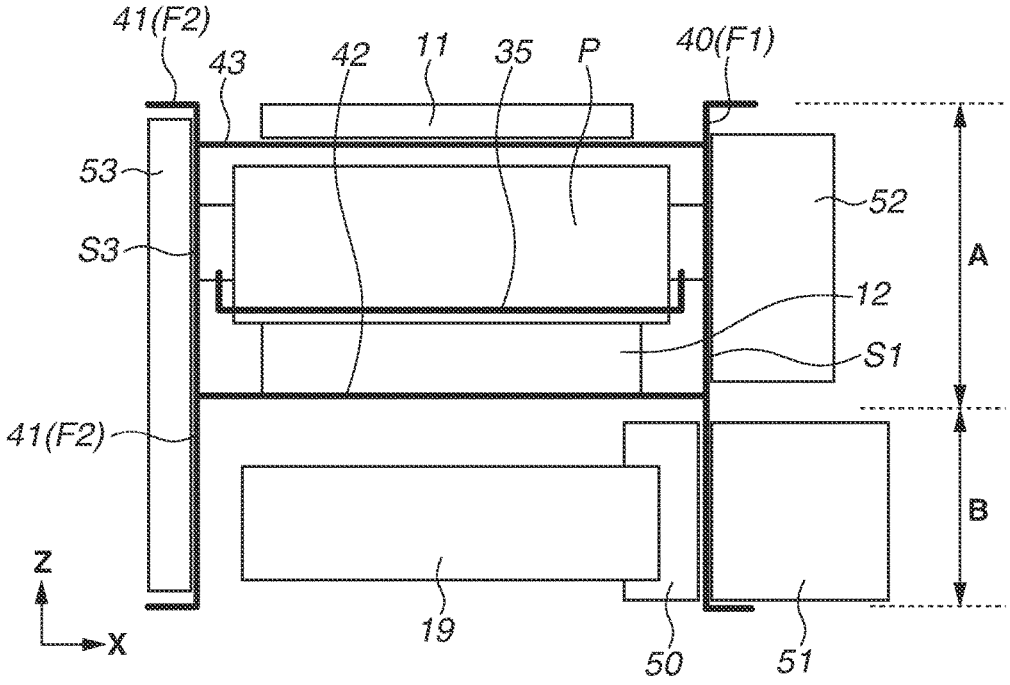
FIG. 7A is a front view illustrating a frame structure and members supported by the frame structure according to a comparative example.
Figure 7B:
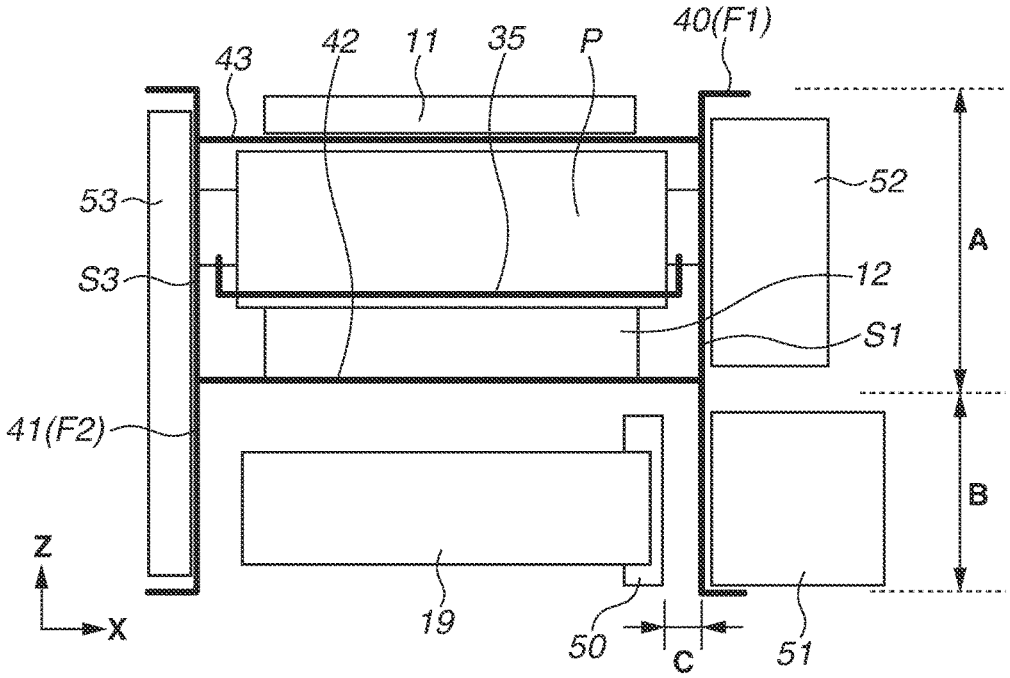
FIG. 7B is a front view illustrating a frame structure and members supported by the frame structure according to another comparative example.
Figure 8:
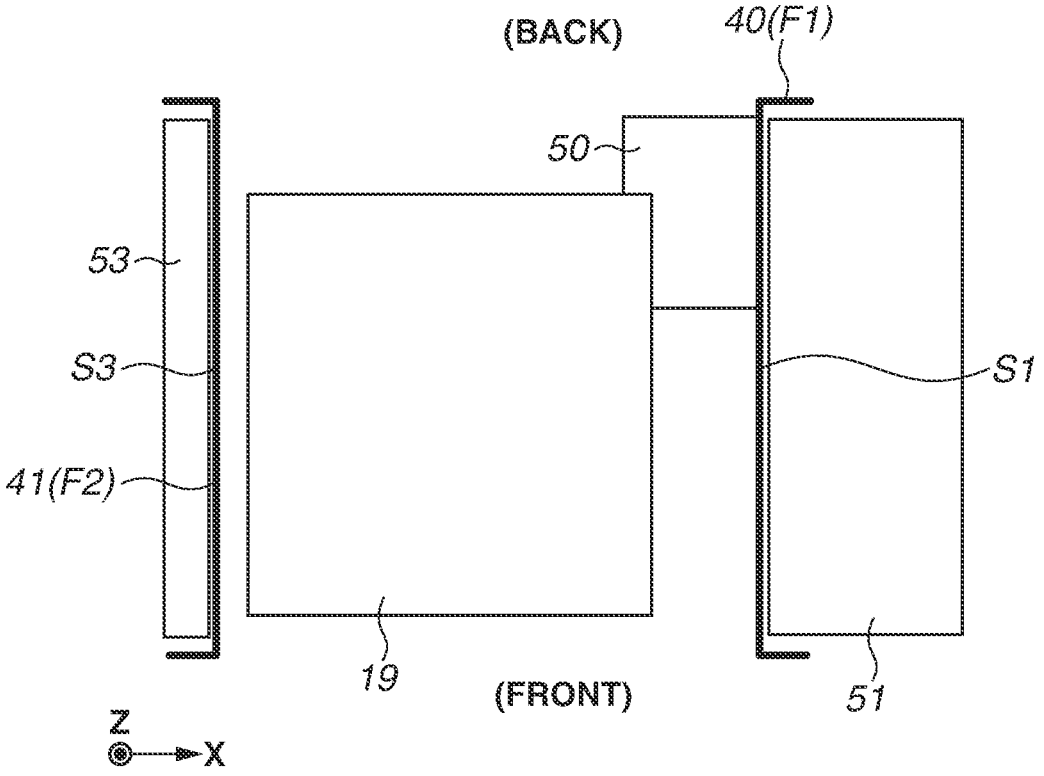
FIG. 8 is a top view illustrating the frame structure and members supported by the frame structure according to the comparative example.

A comparison between the present exemplary embodiment and comparative examples will be described. FIG. 7A is a front view illustrating a frame structure and members supported by the frame structure according to a first comparative example. FIG. 7B is a front view illustrating a frame structure and members supported by the frame structure according to a second comparative example. FIG. 8 is a top view of the frame structure and the members supported by the frame structure according to the first comparative example.

According to the first and second comparative examples, a single right side plate 40 is provided as a first frame F1, and the right side plate 40 includes a single first side surface S1. In the structures according to the first and second comparative examples, the distance between the first side surface S1 of the right side plate 40 and a third side surface S3 of a left side plate 41 is determined by the width in the X direction of a portion A in which a tray 35 is provided. According to the first comparative example, since the width of a power supply unit 51 in the X direction is wide, the width of the image forming apparatus in the X direction may become wide because the power supply unit 51 protrudes in the X direction.

Further, according to the second comparative example, for example, even if the width of a sheet feeding driving unit 50 in the X direction can be decreased, the distance between the first side surface S1 and the third side surface S3 is determined by the width of the portion A in the X direction. Therefore, a space C is formed between the first side surface S1 and the sheet feeding driving unit 50. Thus, it is difficult to reduce the size of the entire body of the image forming apparatus.

Furthermore, as in the first comparative example illustrated in FIG. 8, in also a case where the sheet feeding cassette 19 and the sheet feeding driving unit 50 have different widths from each other in the X direction, a space may be formed between the sheet feeding cassette 19 and the first side surface S1.

On the contrary, according to the present exemplary embodiment, since the first frame F1 includes the right side plate 40*a* and the sheet feeding unit frame 40*b*, the second side surfaces S2*a* and S2*b* are provided in positions that are different from the position of the first side surface S1. Especially, the second side surface S2*a* is provided further inside than the first side surface S1 (on the side closer to the sheet feeding cassette 19), and the portion of the power supply unit 51 in which a relatively large component, such as a transformer, is provided is provided in the position facing the second side surface S2*a*, whereby the power supply unit 51 is prevented from protruding in the X direction. Further, the second side surface S2*b* is provided further outside than the first side surface S1 (on the side opposite to the sheet feeding cassette 19), and the sheet feeding driving unit 50 is provided in the position facing the second side surface S2*b*, whereby formation of an unnecessary space between the second side surface S2*a* and the sheet feeding cassette 19 is prevented. Accordingly, in the frame structure according to the present exemplary embodiment, formation of an unnecessary space is prevented and effective use of the space in the apparatus is enabled. The foregoing effect can be obtained, as long as at least a part of the second side surfaces (S2*a* and/or S2*b*) of the sheet feeding unit frame 40*b* is provided in a position different from the first side surface S1 in the X direction (a position closer to or farther from the third side surface S3 than the position of the first side surface S1).

Further, according to the present exemplary embodiment, the left side plate 41 is a single integrally-formed member, and the third side surface S3 of the left side plate 41 is used as a positioning reference for the basal plate 42, the scanner stay 43, the cartridges P, the belt unit 12, and the sheet feeding unit 18. Thus, the positioning of each member can be conducted with certain accuracy. Especially, it is possible to decrease the effect on the positioning accuracy in the X direction b the structure of the first frame F1 which is divided in the right side plate 40*a* and the sheet feeding unit frame 40*b*.

Figure 9:
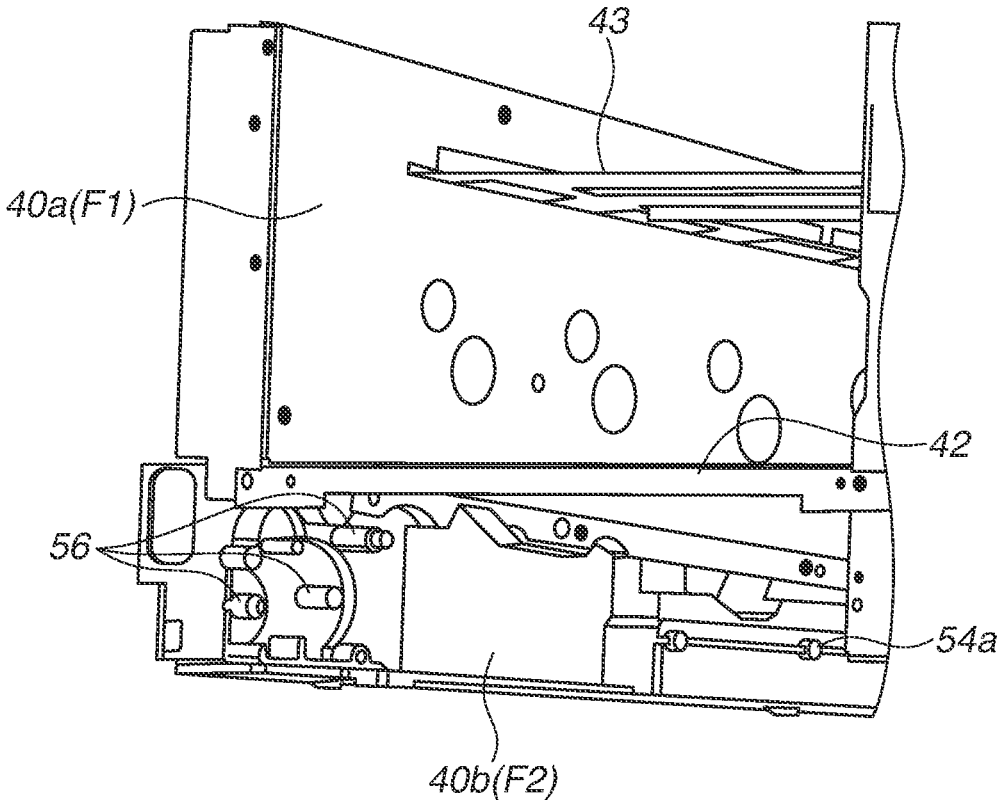
FIG. 9 is a partial perspective view illustrating the frame structure of the image forming apparatus.
Figure 10:
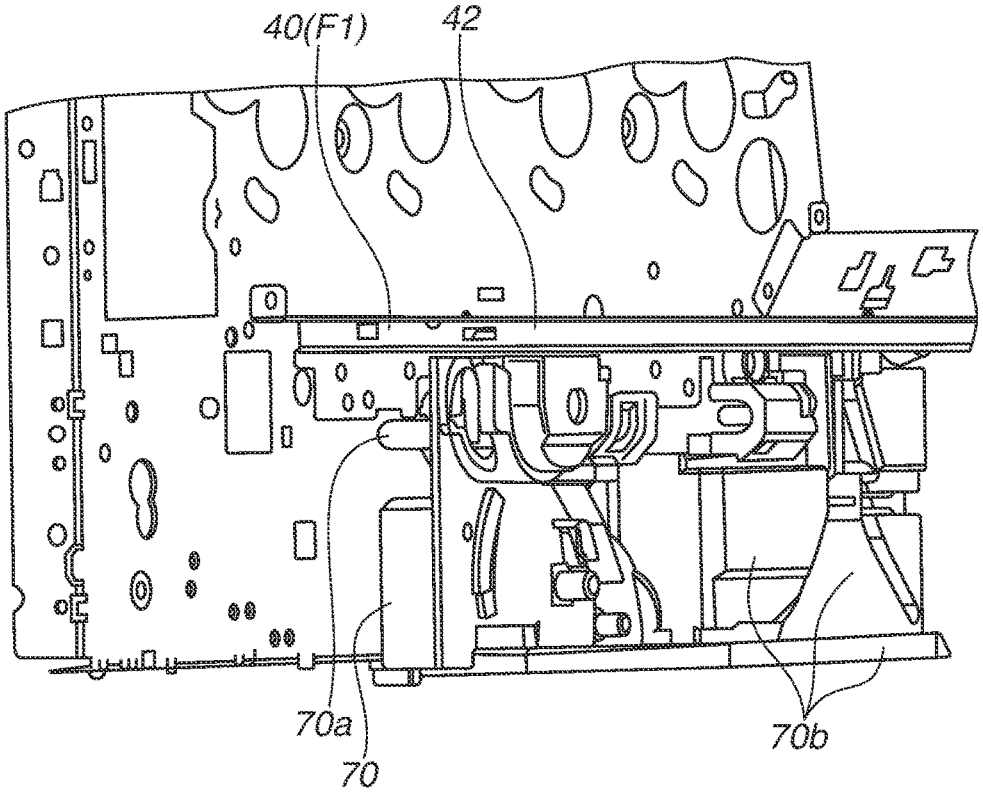
FIG. 10 is a partial perspective view illustrating the frame structure according to the comparative example.

Further, according to the first and second comparative examples, a member 70 including, for example, a shaft 70*a* and a guide 70*b* for the sheet feeding cassette is attached to the right side plate 40, as illustrated in the partial perspective view of the frame structure illustrated in FIG. 10. On the contrary, according to the present exemplary embodiment, the sheet feeding unit frame 40*b* is made of resin so that a shaft 56 and a guide 54 for supporting gears of the sheet feeding driving unit 50 are integrated with the sheet feeding unit frame 40*b*, as illustrated in the partial perspective view of the frame structure of the image forming apparatus illustrated in FIG. 9. Further, the wall surface portion W, which functions as a fireproof enclosure, is integrated with the sheet feeding unit frame 40*b*. Therefore, the number of components can be decreased and assembly costs can be reduced.

Figure 11:
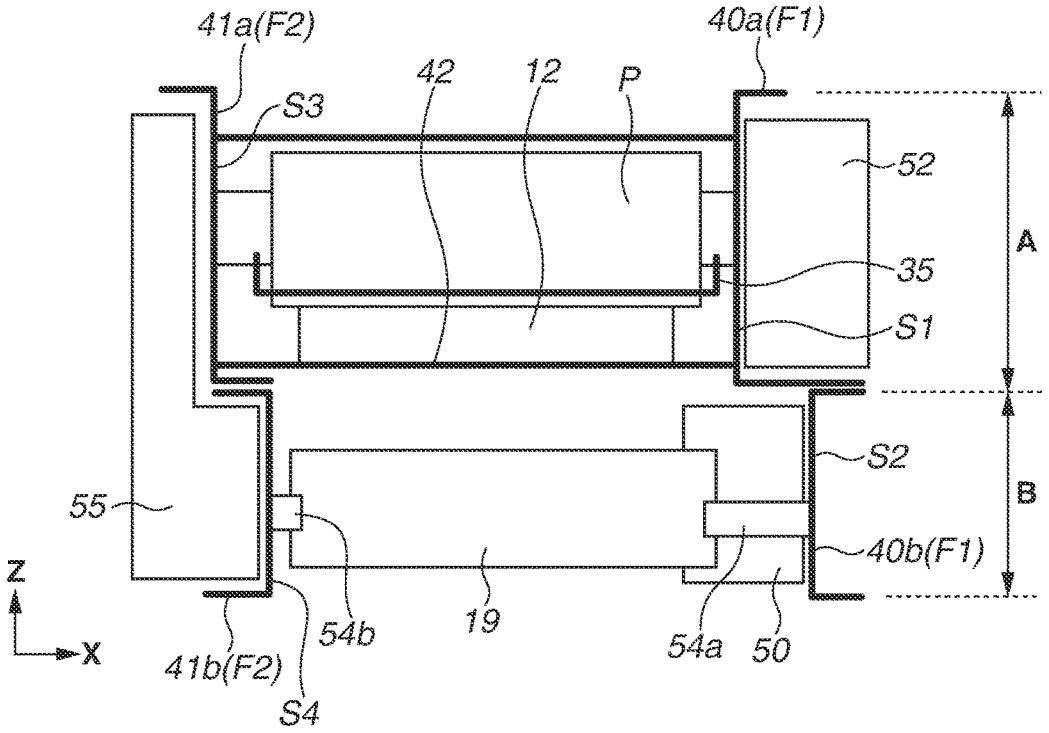
FIG. 11 is a front view illustrating a frame structure of an image forming apparatus and members supported by the frame structure.

A second exemplary embodiment will be described. The present exemplary embodiment is different from the first exemplary embodiment only in a part of the frame structure and the like, and the main structure of the image forming apparatus is similar to that of the first exemplary embodiment. Thus, components similar to those of the first exemplary embodiment are given the same reference numerals, and description of the components is omitted. FIG. 11 is a front view illustrating a frame structure and members supported by the frame structure according to the present exemplary embodiment. According to the present exemplary embodiment, a first frame F1 includes a right side plate 40*a* and a first sheet feeding unit frame 40*b*. The right side plate 40*a* includes a first side surface S1 and the first sheet feeding unit frame 40*b* includes a second side surface S2. Further, a second frame F2 includes a left side plate 41*a* and a second sheet feeding unit frame 41*b*. The left side plate 41*a* includes a third side surface S3 and the second sheet feeding unit frame 41*b* includes a fourth side surface S4. Each of the right side plate 40*a* and the left side plate 41*a* is a metal member, and each of the first sheet feeding unit frame 40*b* and the second sheet feeding unit frame 41*b* is a resin member.

A power supply unit 55 is provided outside the third side surface S3 and the fourth side surface S4 (the side opposite to the cartridge P and the sheet feeding cassette 19). The power supply unit 55 is an integrally-formed power supply unit having the functions of the power supply unit (low voltage power supply unit) 51 and the high voltage power supply unit 53 according to the first exemplary embodiment. Further, the fourth side surface S4 is provided further inside than the third side surface S3 (closer to the sheet feeding cassette 19), and a relatively large component of the power supply unit 55, such as a transformer, is provided in a position facing the fourth side surface S4. In this way, the power supply unit 55 can be prevented from protruding.

According to the present exemplary embodiment, a similar effect to an effect obtained by the first exemplary embodiment can be obtained. Specifically, formation of an unnecessary space can be prevented and effective use of the space in the apparatus is enabled.

The foregoing effect can be obtained, as long as at least a part of the second side surfaces is provided in a position different from the position of the first side surface S1 in the X direction and at least a part of the fourth side surfaces is provided in a position different from the position of the third side surface S3 in the X direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming unit configured to transfer a toner image formed on an image bearing member onto a recording medium;

a stacking unit on which a recording medium to be conveyed to the image forming unit is stacked; and a first frame member and a second frame member which are aligned in a direction of a rotation axis of the image bearing member and face each other across the image forming unit and the stacking unit, wherein the first frame member includes a first side surface facing the image forming unit and a second side surface being provided separately from the first side surface and facing the stacking unit, and the second side surface being fixed to the first side surface, and wherein the second frame member includes an integrally-formed surface, the integrally-formed surface being a reference surface provided commonly for the image forming unit and the stacking unit, wherein the first frame member supports a low voltage power supply unit configured to supply low voltage power to a high-voltage power supply unit, and the low voltage power supply unit is provided on a side opposite to the stacking unit across the second side surface in the direction of the rotation axis of the image bearing member, wherein the high-voltage power supply unit converts the low voltage power into high voltage power and supplies the high voltage power to the image forming unit, and wherein the second frame member supports the high-voltage power supply unit.

2. An image forming apparatus according to claim 1, wherein the stacking unit is provided below the image forming unit, and the stacking unit is attachable to and detachable from a main body of the image forming apparatus.

3. An image forming apparatus according to claim 2, wherein the first side surface is formed of a metal and the second side surface is formed of a resin.

4. An image forming apparatus according to claim 3, wherein the second frame member is formed of a planar metal.

5. An image forming apparatus according to claim 4, wherein at least a part of the second side surface is provided in a position closer to the reference surface than the first side surface in the direction of the rotation axis of the image bearing member.

6. An image forming apparatus according to claim 4, wherein at least a part of the second side surface is provided in a position farther from the reference surface than the first side surface in the direction of the rotation axis of the image bearing member.

7. An image forming apparatus according to claim 1, further comprising a planar connection member formed of a metal, wherein the first frame member and the second frame member are connected together by the planar connection member formed of the metal.

8. An image forming apparatus according to claim 7, wherein the connection member are fixed to the first frame member, and wherein two stay members are provided between the first frame member and the second frame member, and each of the first frame member and the second frame member is fixed to the two stay members.

9. An image forming apparatus according to claim 1, wherein the second side surface includes a wall surface portion protruding from the second side surface in the direction of the rotation axis of the image bearing member, and the wall surface portion is provided, viewed in the direction of the rotation axis of the image bearing member, around the low voltage power supply unit.

10. An image forming apparatus according to claim 1, wherein second side surface includes a support unit configured to support the stacking unit, and the support unit is provided on a side closer to the stacking unit than the second side surface in the direction of the rotation axis of the image bearing member.

11. An image forming apparatus according to claim 1, wherein the second side surface supports a conveying member driving unit configured to drive a conveying member for conveying a recording medium stacked on the stacking unit, and the conveying member driving unit is provided on a side closer to the stacking unit than the second side surface in the direction of the rotation axis of the image bearing member.

12. An image forming apparatus according to claim 1, wherein the first side surface supports an image bearing member driving unit configured to drive the image bearing member.

13. An image forming apparatus according to claim 1, wherein the reference surface is used as a positioning reference for the image forming unit and the stacking unit with respect to a main body of the image forming apparatus.

14. An image forming apparatus according to claim 1, wherein the second side frame includes a shaft and a guide for supporting gears.

* * * * *